United States Patent [19]

Meisenheimer, Jr.

[11] 4,063,057

[45] Dec. 13, 1977

[54] TEMPERATURE COMPENSATED PRESSURE DIFFERENTIAL SENSING DEVICES, INCLUDING IMPROVED PRESS-TO-TEST AND GLASS HEADER SWITCH MOUNTING

[76] Inventor: Daniel T. Meisenheimer, Jr., 404 Longmeadow, Orange, Conn. 06477

[21] Appl. No.: 634,513

[22] Filed: Nov. 24, 1975

Related U.S. Application Data

[63] Continuation-in-part of Ser. No. 353,466, April 23, 1975, Pat. No. 3,922,515.

[51] Int. Cl.[2] ..... H01H 35/34

[52] U.S. Cl. ..... 200/83 Y; 200/83 S; 200/83 C; 340/242

[58] Field of Search ..... 73/263, 264, 406, 410, 73/407 R; 200/83 A, 83 B, 83 C, 83 D, 83 S, 83 Y, 83 R, 83 Q, 153 T, 81.8; 340/236, 240, 242; 337/321; 116/70; 92/34, 40, 43, 45

[56] References Cited

U.S. PATENT DOCUMENTS

| | | | |
|---|---|---|---|
| 3,046,369 | 7/1962 | Hicks | 200/83 C |
| 3,119,910 | 1/1964 | Meisenheimer, Jr. | 200/83 J |
| 3,200,215 | 8/1965 | Good | 200/83 Y |
| 3,335,241 | 8/1967 | Weber | 200/83 S |
| 3,742,165 | 6/1973 | Hellman | 200/83 S |

FOREIGN PATENT DOCUMENTS

| | | | |
|---|---|---|---|
| 441,794 | 1912 | France | 200/81.9 |

*Primary Examiner*—Gerald P. Tolin

*Attorney, Agent, or Firm*—Wooster, Davis & Cifelli

[57] ABSTRACT

A pressure differential sensing device comprises a sealed housing having mounted therein a gas-filled flexible capsule and a switch operated by expansion of the capsule. The pressure differential sensing device is mounted to a pressurized chamber with the pressure of the chamber communicating with the interior of the housing and surrounding the capsule and monitors the chamber for gas leaks. The gas in the pressurized chamber and in the capsule both respond to variations in temperature in a like manner, and a relatively constant pressure differential is thereby maintained between the interior pressure of the capsule and the pressure of the housing. If gas leaks from the pressurized chamber, the pressure of the chamber decreases relative to the interior pressure of the capsule, and the capsule expands to operate the switch. Thus, the device is temperature compensated.

The pressure differential sensing device is calibrated by adjusting the position of the switch relative to the capsule. In one embodiment, the switch is mounted on a threaded collar positioned above the capsule, and the device is calibrated by adjusting the position of the switch. In another embodiment, the capsule is mounted on a first externally threaded collar which is fixed against rotation, and the first collar is mounted to a second interiorly threaded collar which is free for rotation and fixed against axial movement. Rotation of the second collar thereby adjusts the position of the capsule relative to the switch, and such adjustment may be made from outside the housing by providing an access to the second collar through a port in the housing.

In yet another embodiment, the switch is mounted by soldering its metal terminals to eyelets hermetically sealed in a glass header which includes a peripheral metal ring also hermetically sealed thereto. The metal ring is soldered to a cap which defines a substantial portion of the housing of the device, the cap is threadably mounted on the remainder of the housing, whereby the position of the switch relative to the capsule may be adjusted by turning the cap.

The pressure differential sensing device also includes means for testing its operability, and said means comprises a manually operable plunger carrying a plurality of O-seals. The plunger is mounted in an opening intersecting the passage from the pressurized chamber to the interior of the housing. The plunger normally permits communication between the pressurized chamber and the interior of the housing, but upon being manually depressed, operates to seal off the chamber and open the interior of the housing to the atmosphere, or other reference pressure lower than the pressure of the chamber, whereby the capsule expands to operate the switch provided the capsule has maintained its integrity and the device is in good working order. During testing, the O-seals are relieved by being positioned adjacent beveled grooves, and these grooves permit a short stroke of the plunger to the test position and prevent abrasion or excessive wear of the O-seals.

21 Claims, 11 Drawing Figures

Fig. 1.
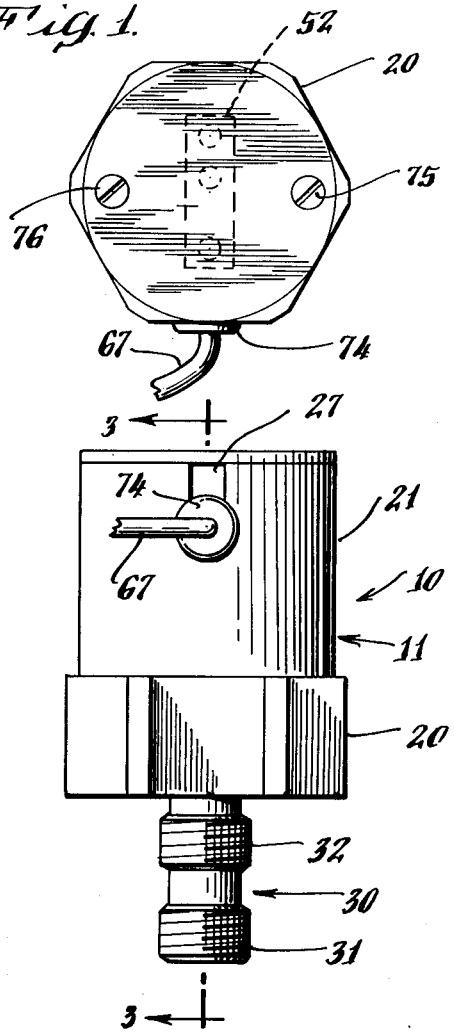
Fig. 3.
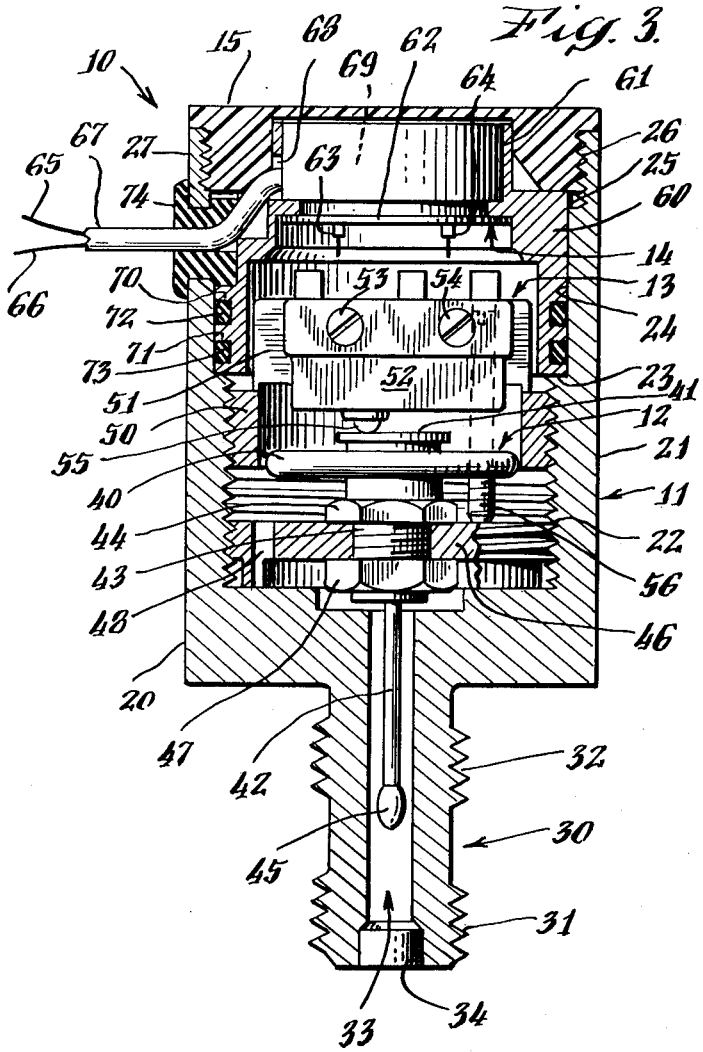
Fig. 2.
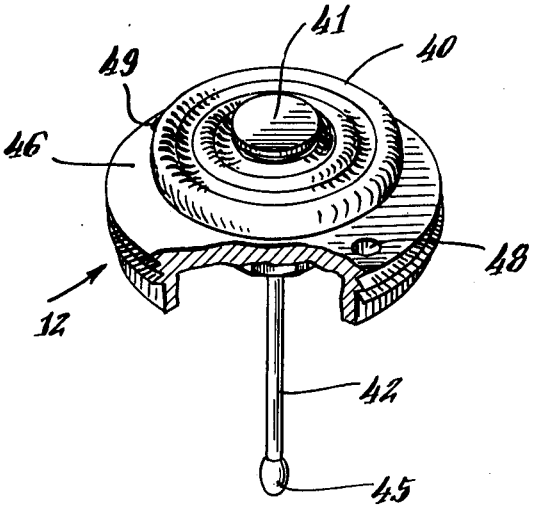
Fig. 4.

Fig. 8.
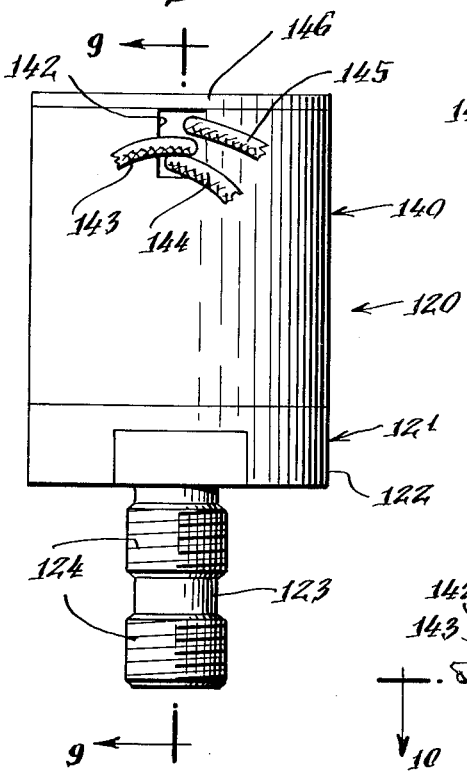
Fig. 10.
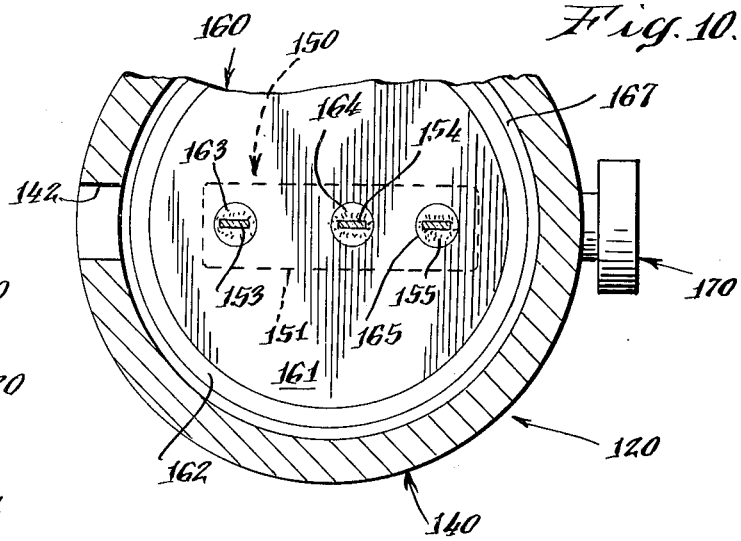
Fig. 9.
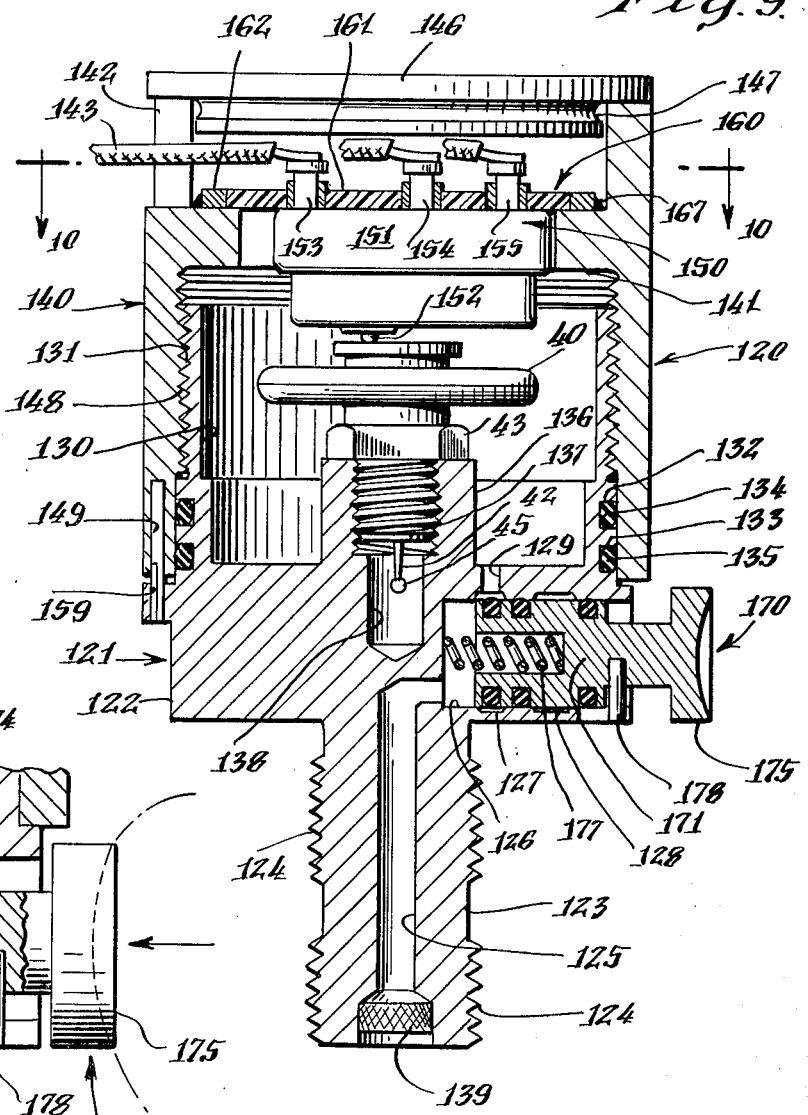
Fig. 11.

TEMPERATURE COMPENSATED PRESSURE DIFFERENTIAL SENSING DEVICES, INCLUDING IMPROVED PRESS-TO-TEST AND GLASS HEADER SWITCH MOUNTING

This application is a continuation in-part of my application Ser. No. 353,466 filed Apr. 23, 1973, now U.S. Pat. No. 3,922,515.

BACKGROUND OF THE INVENTION

This invention relates to devices for sensing pressure differentials, and more particularly to a device for sensing relative pressure differentials in a temperature variable environment. This invention further relates to a structure for a temperature compensated pressure differential sensing device adapted for easy calibration and adapted for easy testing of the operability thereof.

There are many situations wherein it is desirable to monitor the status of a pressurized device. One such situation relates to helicopters, and more particularly to helicopter blades which are hollow and filled with a pressurized gas. A loss of or decrease in the pressurization of the blade indicates a defect in the structural integrity of the blade. Defects may be caused by traumatic damage, such as bullet holes, or may be caused by other structural failure, such as fatigue cracks. It is important for the pilot of a helicopter to know immediately if depressurization has occurred, so that he may take appropriate action including landing the helicopter promptly for repairs.

The helicopter blade environment poses problems to a successful pressure monitoring device. A helicopter operates at varying altitudes and consequent wide ranges of temperatures which cause the pressurization of the blade to change. Further, there are vibration and stress loads present in this environment. Also, there is a need for prompt and accurate information concerning pressurization of the blades, and fail-safe operation of the indicator itself is preferable. In addition, such a device should be capable of fast and simple testing of its operability, and provisions for such testing must not in and of themselves be a source of failure.

Prior art helicopter blade pressure monitoring devices made no attempt to provide an indication of depressurization during flight. These prior art devices were primarily useful for measuring gross deviations in pressure, and had to be read prior to and after flights, and slow depressurization caused by a fatigue crack might not become apparent on the indicator for a substantial period of time.

SUMMARY OF THE INVENTION

The temperature compensated pressure differential sensing device according to the invention herein comprises a closed housing communicating with the interior of a pressurized container the pressure of which is being monitored. Mounted within the closed housing is a gas-filled capsule comprising facing convoluted diaphragms secured together at their peripheries, one side of the capsule having a fill tube extending outwardly therefrom, and the other side of the capsule having a flat, raised surface. A push button actuated switch is mounted within the housing with the push button engaging the raised flat portion of the capsule wherein the switch is actuated by expansion of the capsule.

The capsule is filled with the same gas as is in the monitored pressurized cavity. Therefore, as the cavity and the capsule are together subjected to varying temperatures, the gas responds in the same way so that the pressure differential between the pressurized cavity and the capsule remains constant, wherein the capsule does not expand and actuate the switch. However, if there is a gas leak from the pressurized cavity, the cavity pressure is thereby reduced and the pressurization of the capsule is then greater in comparison to the pressurization of the cavity, wherein the capsule expands and actuates the push button switch. The switch is connected to a panel light or other means for indicating that depressurization has occurred.

If the capsule seals fail, the pressure inside and outside the capsule becomes equalized. However, the capsule is constructed and initially pressurized such that it is in a contracted position, and equalization of the pressure because of a leak in the capsule permits expansion of the capsule and activation of the switch. Although this is a false indication that the pressurized cavity has failed, it is nevertheless a desired indication that the pressure monitoring device is not functioning.

The operability of the temperature compensated pressure differential sensing device may be checked by means of a "press-to-test" feature, which consists of a manually depressable plunger mounted in an opening intersecting a passage providing communication between the interior of the housing and the pressurized chamber. The plunger carries a plurality of O-seals which normally seal the opening with respect to the outside atmosphere. Upon depressing the plunger, the O-seals are moved to a position sealing off the pressurized chamber, thereby preventing loss of gas therefrom, and opening the interior of the housing to the atmosphere, whereby the pressure differential sensing device will signal low pressure provided it is in good working order. The opening which receives the plunger and the O-seals carried thereon has peripheral grooves formed therein, and the O-seals are loosely accommodated in these grooves to relieve their sealing function at the appropriate time in the test sequence. These grooves achieve a "short stroke" advantage for the press-to-test feature. In addition, the grooves are smoothly beveled at their edges and do not abrade or damage the O-seals as the plunger is depressed and released.

The pressure differential sensing device is calibrated in one of three ways, according to first, second, and third embodiments of the invention. In accordance with the first embodiment, the switch is mounted in the housing on a threaded collar wherein rotation of the collar adjusts the proximity of the switch to the diaphragm. The device is calibrated by altering the position of the switch until the desired indications are achieved for a given pressure and a pressure slightly reduced therefrom.

In the second embodiment of the invention, the switch is fixed within the housing, and the capsule is carried on a threaded collar which is free for movement towards and away from the switch but is fixed against rotation. The collar is threadingly engaged with a rotatable sleeve, access to which is provided by an opening through the housing. Thus, turning the sleeve adjusts the position of the capsule relative to the switch, and the capsule is calibrated by pressurizing the housing to a high pressure and thereafter bleeding the pressure to the desired "alarm" pressure, while monitoring the switch condition. The sleeve is rotated until the desired indication is received at the "alarm" pressure.

In the third embodiment of the invention, the housing is comprised of a housing cap and a base on which the housing cap is threadably received. The capsule is mounted to the base of the housing. The switch is mounted to the cap by means of a glass header, which comprises a glass plate having a peripheral metal ring hermetically sealed thereto and eyelets also hermetically sealed thereto. The switch is mounted to the glass header by inserting the switch terminals through the eyelets and securing them by solder to achieve a gas-tight seal. The metal ring is soldered to the housing cap, also achieving a gas-tight seal. The housing cap, with the switch mounted thereon by means of the glass header, is then threaded onto the base, thereby assembling the housing and adjusting the position of the switch relative to the capsule in a manner similar to that described above. The use of the glass header as a switch mount materially reduces the number of parts as compared to the first and second embodiments of the invention, and also reduces the reliance on potting compounds and O-seals in sealing the housing.

OBJECTS OF THE INVENTION

It is a principal object of the invention to provide a pressure differential sensing device for detecting leaks in pressurized containers.

It is an additional object of the invention to provide a pressure differential sensing device for detecting leaks in pressurized containers wherein the containers are subjected to varying temperatures.

It is a further object of the invention to provide a pressure differential sensing device which incorporates means for remote indication of the sensed condition.

It is another object of the invention to provide a rugged temperature compensated pressure differential sensing device suitable for aircraft and other environments requiring high reliability and durability.

It is still a further object of the invention to provide a temperature compensated pressure differential sensing device the calibration of which may be externally adjusted.

These and other objects of the invention will in part be obvious and will in part appear in the following description of the preferred embodiments taken together with the drawings.

DRAWINGS

FIG. 1 is a top plan view of a temperature compensated pressure differential sensing device according to the invention herein;

FIG. 2 is a side elevation view of the device of FIG. 1;

FIG. 3 is a sectional view of the device of FIG. 1 taken along the lines 3—3 of FIG. 2;

FIG. 4 is a perspective view of a pressurized capsule and mounting collar incorporated in the device of FIG. 1;

FIG. 8 is a side elevation view of another embodiment of a temperature compensated pressure differential sensing device according to the invention herein;

FIG. 9 is a sectional view of the device of FIG. 8 taken along the lines 9—9 of FIG. 8;

FIG. 10 is a sectional view of the device of FIG. 8 taken along the lines 10—10 of FIG. 9; and FIG. 11 is an enlarged sectional view, corresponding to FIG. 9 and partially broken away, showing the press-to-test plunger depressed.

The same reference numbers refer to the same elements throughout the various figures.

DESCRIPTION OF THE PREFERRED EMBODIMENTS

Figure 5:
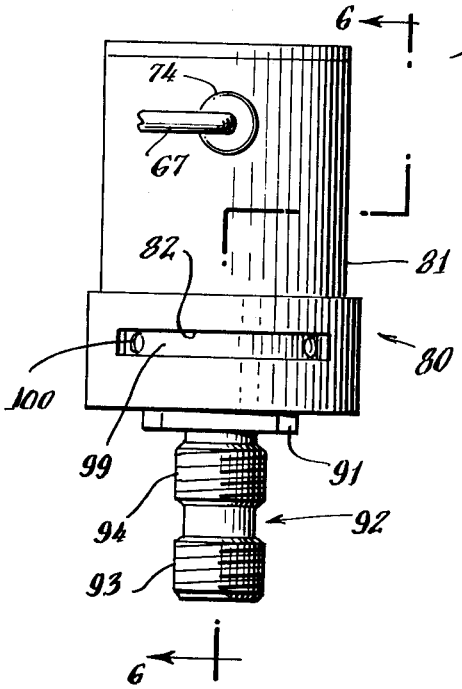
FIG. 5 is a side elevation view of another embodiment of a temperature compensated pressure differential sensing device according to the invention herein.

A first embodiment 10 of a pressure differential sensing device according to the invention herein is shown in FIGS. 1 - 4. It generally comprises a housing 11, a filled capsule subassembly 12, a switch subassembly 13, a wire-header subassembly 14, and a closure cap 15.

The housing 11 comprises a hexagonal base 20 having a cylindrical portion 21 extending upwardly therefrom, the base 20 and the cylindrical portion 21 together defining a cavity for receiving the various subassemblies.

The interior of the cylindrical portion 21 of housing 11 is internally threaded at 22 beginning above the hexagonal base 20 and extending upwardly to a shoulder 23. Above shoulder 23 is a larger diameter smooth interior portion 24 extending upwardly from the shoulder 23 to a second shoulder 25. The remaining interior surface of cylindrical portion 21 is internally threaded at 26. A slot 27 extends downwardly from the top of the cylindrical portion 21 and terminates within the span of the smooth interior surface 24. Extending downwardly from the hexagonal base 20 is a shank 30 which is externally threaded at 31 and 32 for securing the pressure differential sensing device 10 to a pressurized chamber (not shown). The shank 30 further includes a central bore 33 connecting the tip of the shank and the interior of the housing 11. A filter 34 may be provided within the bore 33 at the tip of the shank to prevent particulate matter from contaminating the interior of the housing.

The filled capsule subassembly 12 is shown isolated in FIG. 4 and is also shown in FIG. 3. It comprises a capsule 40 which is fabricated from two convoluted diaphragms joined together along their peripheral edges. Extending upward from the top of capsule 40 is a raised flat surface 41, and extending downward from the underside of capsule 40 is an elongated fill stem 42. The fill stem 42 extends through a threaded collar 43 having a hexagonal head portion 44, and the stem 42 of capsule 40 is secured therein by solder with the collar 43 positioned adjacent to the underside of capsule 40.

The capsule 40 is filled with a gas to a preselected pressure. This is accomplished by heating the capsule to approximately 200° F. in order to vaporize any moisture therein, and thereafter evacuating the capsule through stem 42. The capsule is then backfilled with gas through stem 42 to a pressure substantially greater than the preselected pressure, the temperature of the capsule being maintained during backfilling. The evacuating and backfilling steps are repeated several times to insure purging of all air and moisture from the capsule.

The capsule, backfilled with gas at the substantially greater presssure, is then cooled to room temperature. The pressure within the capsule is then bled to the desired pressure, the desired pressure being determined as the preselected pressure compensated for existing temperature and barometric deviations. The stem 42 is then crimped and soldered, as indicated at 45, to seal the gas within capsule 40.

The capsule 40 is preferably filled with the same gas as is in the pressurized chamber to which the pressure differential sensing device is mounted. In the case of helicopter rotor blades, the gas is normally a mixture of 90% nitrogen and 10% helium, the helium functioning as a tracer element permitting the use of spectroscopy techniques in locating gas leaks. By using the same gas for filling the capsule as is used in a pressurized chamber, the gas in both the capsule and the chamber responds to temperature changes in a like manner according to Boyle - Charles Laws.

In an assembled pressure differential sensing device mounted to a pressurized chamber, the capsule 40 is surrounded by gas from the chamber. Thus, there are three main forces acting on the capsule: first, the external gas pressure of the chamber; second, the internal gas pressure of the capsule; and third, the forces inherent in the capsule itself when it is held in a position other than its free position by the first two forces.

The basic operating principle of the pressure differential sensing device disclosed herein is that a loss of gas from the pressurized chamber to which it is mounted decreases the pressure outside capsule 40, permitting capsule 40 to expand and actuate a signalling device. The chamber pressure varies with temperature, and if an evacuated capsule were used, the device would signal in response to lowered pressure due to decreased temperature or in response to lowered pressure due to loss of gas. The gas within the capsule compensates for the variations in temperature by also responding thereto.

A temperature-pressure curve is established for the chamber assuming no loss of gas therefrom. This curve normally discloses a substantial linear relationship between temperature and pressure.

It has been found that selection of the backfill pressure of the capsule determines the slope of response of the capsule, and that a "trial and error" empirical determination of the desired backfill pressure can be made such that the capsule will "track" the temperature-pressure curve of the chamber, i.e., the capsule responds only if the pressure of the chamber is below the pressure expected for the given temperature. The desired backfill pressure is necessarily an empirical value because the variety of parameters associated with the capsule, including the inherent spring forces and variable volume of the capsule itself, make calculation of a value extremely difficult.

The normal pressurization of gas in a helicopter rotor blade is approximately 15 p.s.i. above sea level pressure, which is substantially higher than the initial pressurization of capsule 40. Capsule 40 is thereby normally compressed from its free, relaxed position, which provides a fail-safe mode, as will be more fully discussed below.

After initial pressurization of capsule 40 has been accomplished, the capsule 40 and its associated threaded collar 43 are positioned in a mounting collar 46 by turning collar 43 into a central internally threaded bore therein, and the capsule is secured in the mounting collar 46 by means of a nut 47 threaded onto the lower portion of collar 43. This structure comprises the filled capsule subassembly 12. The mounting collar 46 is externally threaded, the threads mating with threads 22 of housing 11, and the filled capsule subassembly 12 is mounted in the housing 11 by turning mounting collar 46 into threads 22 of housing 11 until the collar bottoms on the base 20, as shown in FIG. 3. Two holes 48 and 49 provide communication between the bore 33 and the portion of the interior of housing 11 above the mounting collar 46.

The fill tube 42 extends into bore 33 when the capsule is positioned in housing 11, and access to the fill tube 42 is available through bore 33. Reevacuation and reback-filling of the capsule is provided by the length of capillary. Also, one may crimp all or a portion of the fill tube to decrease the volume of the capsule and fill tube, should it be desired to do so.

The switch subassembly 13, best seen in FIG. 3, comprises a threaded cylindrical collar 50 having mounted thereon a cross piece 51 to which a switch 52 is secured by means of screws 53 and 54. The switch is a snap-action, single throw, double pole switch operated by a push button 55 which depends downwardly from the switchbody in the orientation in which the switch is mounted. The preferred switch is identified by specification No. MS25085-1.

The switch subassembly 13 is installed in the housing 11 by screwing the threaded collar 50 into the threads 22, and the position of the collar 50 establishes the proximity of push button 55 to the top surface 41 of the capsule 40. The position of push button 55 determines the amount of expansion of the capsule 40 which is necessary to operate the switch. Thus, the pressure differential sensing device is calibrated to a certain temperature adjusted pressure by means of adjusting threaded collar 50. This is accomplished by temporarily sealing the upper end of housing 11 and pressurizing the housing to a high pressure. In preparing a sensing device for installation in a helicopter blade where the normal pressure is 15 p.s.i. above sea level pressure and the desired "alarm" pressure may be 5 p.s.i. above sea level pressure at 70° F., the initial pressurization may be 10 – 15 p.s.i. above sea level pressure. The capsule should be sufficiently compressed with respect to the switch at the high housing pressure that the switch is not actuated. The pressure is then bled until the switch is operated, and the position of the collar 50 is adjusted until the switch is operated at the proper "alarm" pressure. Care must be taken during this procedure to maintain the temperature of the capsule and housing at a constant level, and to adjust the switch for operation at the proper "alarm" pressure for that temperature.

The collar 50 is locked in position by means of a screw 56 extending downward and butting against collar 46 once the calibrated position of the switch is achieved.

The wire-header subassembly 14 comprises a cylindrical member 60 having an outside diameter approximately equal to the inside diameter of the smooth inside surface 24 of the housing 11. The cylindrical member 60 has a smaller diameter cylindrical portion 61 extending upwardly therefrom, and plate 62 is provided therebetween. Terminals 63 and 64 extend through the plate 62 wherein they are exposed adjacent to switch 52 for connection to the terminals thereof. Above plate 62 the terminals 63 and 64 are connected to wire leads 65 and 66, surrounded by sheathing 67, which extend out of the upper cylindrical portion 61 at a port 68. Upon assembly of leads 65 and 66 to the upper portions of terminals 63 and 64, the space above plate 62 and surrounded by cylindrical portion 61 is sealed with a potting compound, as indicated at 69.

A rubber grommet 74 is provided around sheating 67 for sealing the slot 27. An elongated rubber grommet may be used, or a round grommet as shown may be used with the area of a slot above the grommet 74 being potted or otherwise sealed against moisture intromission or the like.

The outer periphery of the cylindrical portion 60 of the wire-header subassembly 14 is provided with peripheral grooves 70 and 71 in which are carried two O-ring seals 72 and 73. The wire-header subassembly 14 is slid into the housing 11 and the O-rings provide a seal between the cylindrical member 60 and the smooth inner surface 24 of the housing 11. Therefore, the wire-header subassembly 14 together with the housing 11 defines a closed cavity surrouding the capsule 40, the cavity communicating with the tip of shank 30 through bore 33.

Assembly of the pressure differential sensing device is completed by screwing a threaded cap 15 in to the internal threads 26 of housing 11, and securing cap 15 against rotation by means of screws 75 and 76. The cap 15 provides a completed assembly restraining the wire-header subassembly 14 from being blown out or moved upward by pressure, and the cap 15 further provides an environmental seal for the potted wire leads.

The pressure differential sensing device 10 described above is mounted to a pressurized chamber such as a helicopter blade by providing a threaded opening therein for receiving the threaded shank 30. The bore 33 thereby communicates with the interior of the chamber, and the pressure thereof is equalized with the pressure of the interior of the housing 11 surrounding the capsule 40. As the chamber and the capsule are subjected to variations in temperature, variations of their internal pressures occur. However, the overall forces on the capsule from the pressures are maintained in balance, and the capsule does not expand to operate switch 52.

In the event that the pressurized chamber loses some of its gas, the pressure of the chamber is reduced with respect to the pressure of capsule 40 and the capsule expands, thereby depressing the push button 55 to operate the switch 52. When the switch is operated, an indicator such as a panel light may be illuminated thereby indicating at a remote position that gas loss and depressurization has occurred. The actual pressures at the time of a leak may vary widely depending on temperature, but such actual pressures do not affect operation of the device. The device is sensitive only to changes in the relative pressures of the chamber and capsule.

If the integrity of the capsule 40 itself should fail, the pressure inside capsule 40 becomes equalized with the pressure in the chamber. If the initial pressure of capsule 40 was below the pressure of the chamber, the capsule 40 was thereby normally maintained in a contracted or compressed condition. Equalization of the pressure within the capsule permits the capsule to expand, thereby depressing push button 55 and indicating gas loss or depressurization of the chamber. Although in this situation the chamber is actually not depressurized and the signal is false, it is nevertheless helpful for this signal to occur to indicate that the monitoring system is not in proper working order.

Figure 7:
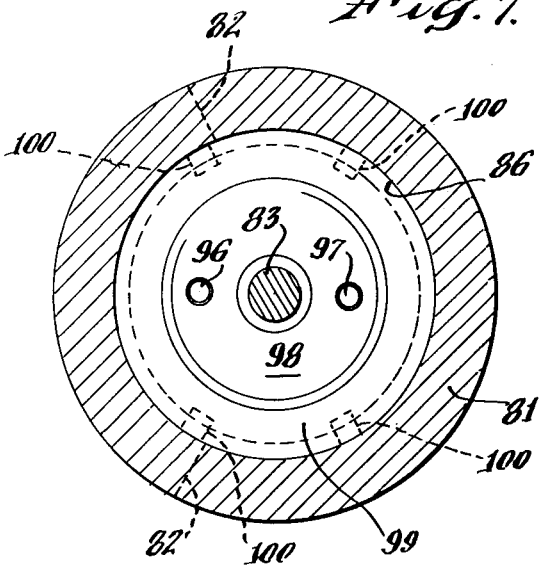
FIG. 7 is a sectional view of the device of FIG. 5 taken along the lines 7—7 of FIG. 6.
Figure 6:
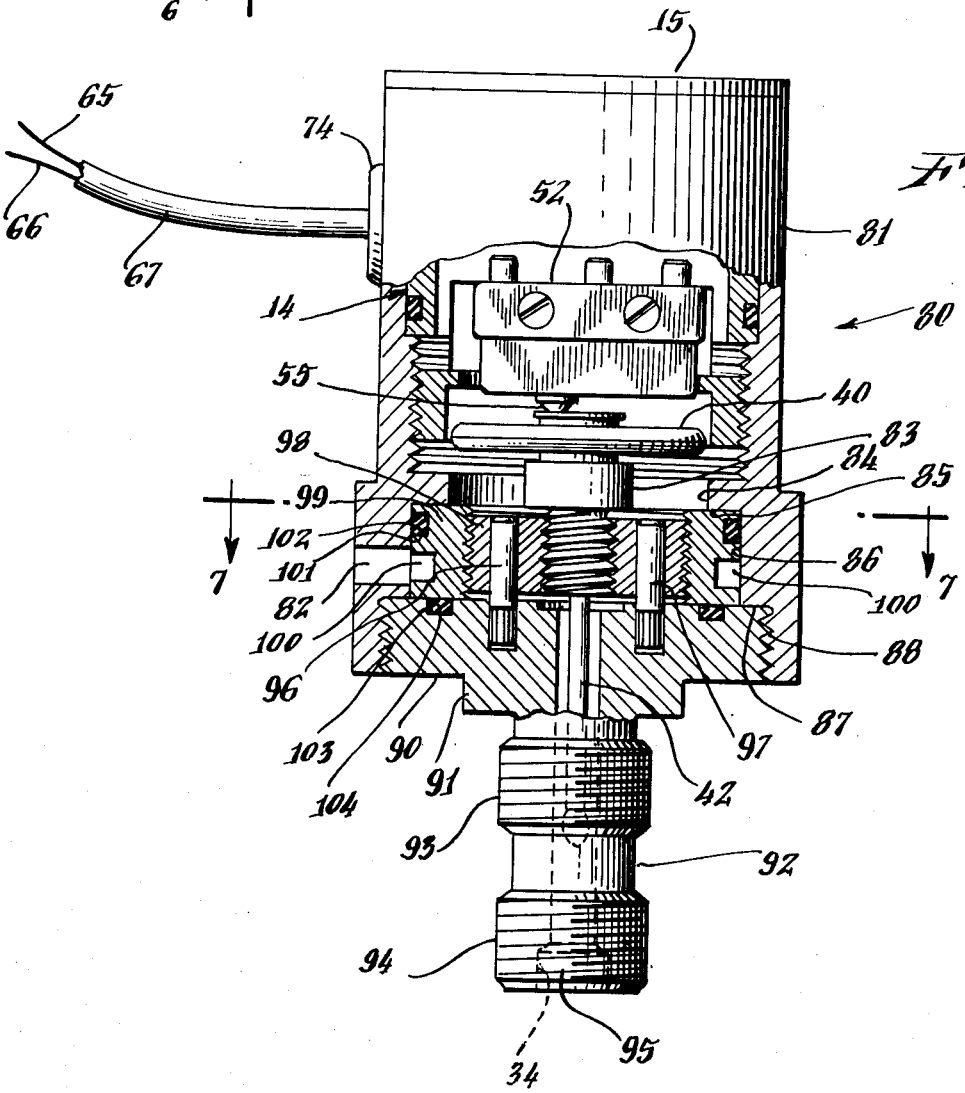
FIG. 6 is a side view partially in elevation and partially in section of the device of FIG. 5.

Referring now to FIGS. 5 – 7 a second embodiment 80 of a temperature compensated pressure differential sensing device according to the invention herein is shown. The operating principle of the pressure differential sensing device 80 is the same as in the first embodiment 10, i.e., a pressurized capsule 40 is positioned within a pressurized housing adjacent to a switch 52 wherein changes in the pressure differential between the capsule and a chamber in communication with the housing cause operation of the switch. However, in the embodiment 80 the switch is held stationary and the capsule is movable relative to the switch for calibrating the device. Further, the embodiment 80 includes means for moving the capsule relative to the switch from outside the housing and after final assembly of the device.

Referring now to FIGS. 5 and 7, the pressure differential sensing device 80 comprises a generally cylindrical housing 81 through with a port 82 is provided. The switch subassembly 13, the wire-header subassembly 14 including the associated sealing devices and potting compounds, and the cap 15 are the same as described above with respect to the first embodiment 10. During assembly of these items into housing 81, the position of switch subassembly 13 is preselected within a desired range, and the switch subassembly is locked at that position.

The housing 81 further comprises an annular flange 84 extending inwardly from the housing wall and forming on its underside a shoulder 85. The interior of the housing further comprises a smooth portion 86, which is intersected by the port 82. A shoulder 87 and a threaded portion 88 complete the interior of the housing 81.

The housing 11 is provided with a bottom plate 90 which is screwed into threads 88 to abut against shoulder 87. Extending downwardly from the bottom plate 90 is a shank 92 having threads 93 and 94 on an outside surface thereof. The shank 93 has a hollow bore 95 passing therethrough. A filter 34 may be provided at the end of the bore. The bottom plate 90 is provided with a hexagonal head 91 which facilitates turning the bottom plate into the housing and also facilitates mounting the assembled pressure differential sensing device 80 into a helicopter blade or other chamber.

Upstanding from the bottom plate 90 are two pins 96 and 97 which pass through openings in a collar 98 and secure the collar 98 against rotation. A capsule 40 as shown in FIG. 4 is evacuated and backfilled with gas as described above. The capsule is mounted in a threaded collar 83, and is attached to the collar 98 by means of collar 83.

The threaded collar 98 is surrounded by an internally threaded annular collar 99 which is constrained between shoulder 85 and bottom plate 90. The outside surface of collar 99 mates with the smooth inner surface 86 of housing 81, wherein collar 99 is free for rotation.

Rotation of collar 99 causes collar 98 to be moved either upwardly or downwardly on the mating threads between collars 98 and 99, the direction of movement depending on the direction of such rotation. Movement of collar 98 in turn adjusts the position of capsule 40 relative to the push button 55 of switch 52 for calibrating the pressure differential sensing device 80 to the desired "alarm" pressure.

Rotation of collar 99 may be accomplished from outside housing 11 by engaging one of the indentations 100 provided in the outer surface of collar 99 through port 82, as best seen in FIGS. 5 and 7.

Collar 99 is provided with a peripheral groove 101 and O-ring seal 102 for maintaining an airtight seal between the housing wall and the collar. Bottom plate 91 is provided with an annular groove 103 carrying an O-ring seal 104 to complete sealing of the interior of the housing 81, except for the pressure communication path provided by bore 95.

The pressure differential sensing device 80 is mounted to a pressurized cavity via threaded shank 92, wherein the pressure of the cavity communicates with the interior of the housing through bore 95. Operation of the embodiment 80 is similar to the operation of the embodiment 10. A loss of gas and the resultant depressurization in the helicopter blade or other chamber to which the device is attached permits capsule 40 to expand and operate switch 52.

The advantage of the embodiment 80 of the pressure differential sensing device is the ease of calibration. Calibration of the device can be accomplished after it has been installed to a chamber, calibration being accomplished by pressurizing the chamber to the desired "alarm" pressure and rotating collar 99 to move the capsule 40 upward until switch 52 is operated. The chamber may then be pressurized to its normal pressure, which will compress capsule 40 such that switch 52 is not operated.

Calibration of the embodiment 80 at the time of manufacture is also more easily accomplished. Particular advantages include the ability to calibrate after final assembly of the housing, and the ability to calibrate without touching the housing, which introduces unwanted temperature variations at the time of calibration.

A temperature compensated pressure differential sensing device 110 comprising a third embodiment of the invention herein is shown in FIGS. 8–11. It is characterized by ease of calibration, a low number of parts, in part achieved through the use of a glass header in mounting the switch, and an improved press-to-test structure which provides for testing the operability of the temperature compensated pressure differential sensing device 110.

The temperature compensated pressure differential sensing device 110 generally comprises: a housing 120 including a base 121 and a housing cap 140 threadably received thereon; a gas-filled flexible capsule 40 mounted to the base 121; a switch subassembly 150 including a switch 151 mounted to the housing cap 120 by means of a glass header 160; and a press-to-test subassembly 170.

The base 121 of the housing 120 comprises a generally round bottom plate 122. A mounting shank 123 depends downwardly therefrom and is provided with threads 124 for securing the temperature compensated pressure differential sensing device 110 to the housing of a pressurized chamber (not shown). The mounting shank 123 defines a bore 125, as best seen in FIG. 9, which communicates with an opening 126 in the bottom plate 122. The opening 126 receives the press-to-test subassembly 170, described in detail below. An additional portion of the bore, indicated by reference numeral 129 is defined in the bottom plate 122 to complete a passageway from the tip of mounting shank 123 to the interior of housing 120. A filter 139 may be provided in bore 125 adjacent to the lower tip of mounting shank 123.

The base 121 further comprises a cylindrical side wall 130 upstanding from the bottom plate 122 and the cylindrical side wall 130 is provided with exterior threads 131 along its upper portion. Two outwardly-facing peripheral grooves 132 and 133 are provided between threads 131 and bottom plate 122, and the grooves 132 and 133 carry O-seals 134 and 135 respectively.

A cylindrical stud 136 is integral with an upstands from a central portion of the bottom plate 122 opposite the mounting shank 123, and stud 136 is interiorly threaded at 137 to receive the threaded portion of collar 43 carrying capsule 40. The fill-stem 42 of capsule 40 is accommodated in a bore 138 extending partially through the bottom plate 122. The capsule 40 and the procedure with which it is filled with gas are described above.

The housing cap 140 is generally cylindrical and is preferably provided with an inwardly protruding shoulder 141 to which the switch subassembly 150 is mounted. The switch subassembly 150 is comprised of a glass header 160 and a switch 151 having an actuating button 152. As best seen in FIGS. 9 and 10, the glass header 160 comprises a round glass plate 161 which has a circular metal ring 162 hermetically sealed to the outer periphery thereof. The glass plate 161 is provided with three openings therethrough in which, respectively, eyelets 163–165 are positioned and hermetically sealed to the glass plate 161. The switch 151 includes three terminal pins 153–155 which are inserted throught the metal eyelets 163–165 and soldered thereto to provide a gas-tight and water-tight seal, thereby also accomplishing mounting of the switch 151 to the glass header 160 to comprise the switch subassembly 150. The switch subassembly 150 is mounted to the housing cap 140 by placing it therein with the peripheral portion of the glass header 160 and metal ring 162 resting on the shoulder 141 of housing cap 140. The metal ring 162 is soldered to shoulder 141 to achieve a gas-tight and water-tight seal, as indicated at 167.

Three insulated wire leads 143–145 are respectively soldered to the terminal pins 153–155 of switch 151, and the insulated wire leads 143–145 exit the housing cap 140 through an opening 142 therein best seen in FIG. 8. A top cap 146 is positioned over the upper end of the housing cap 140, and the top cap 146 may include a depending portion defining a peripheral groove 147. Potting compound is preferably placed in the space between the glass header 160 and the top cap 146 and some of the potting compound flows into the groove 147 to secure the top cap 146 to the housing. Alternatively, the top cap 146 may be secured to the housing cap 140 by machine screws or the like. The wire leads 143–145 are connected with means providing an alarm signal upon actuation of switch 151.

The interior wall of the housing cap 140 is provided with threads 148, whereby the housing cap 140 and the switch subassembly 150 mounted thereto is threadably mounted to the base 121 in order to form the complete housing 120. Sealing between the housing cap 140 and the base 121 is accomplished by the O-seals 134 and 135. The switch button 152 is readily adjusted to the proper position with respect to the capsule 40 by turning the housing cap 140 relative to the base 131. When the switch is at the position which provides the desired alarm signal upon loss of gas from the pressurized chamber and the consequent decrease in pressure therein, the housing cap 140 and the housing base 121 are secured together by drilling an opening 149 simulataneously therethrough and inserting a pin 159 into the opening 149.

The temperature compensated pressure differential sensing device 110 further comprises the press-to-test subassembly 170, which in turn generally comprises a plunger 171 positioned in opening 126 and biased outwardly by a coil spring 177. The plunger 171 is restrained from outward movement beyond the position shown in FIG. 9 by a pin 178, and the plunger 171 is manually depressible inwardly against the coil spring 177 to the test position shown in FIG. 11.

More particularly, the plunger 171 is provided with three annular grooves 172, 173 and 174 in which O-seals 182, 183 and 184 are carried, respectively. The interior of the opening 126 is provided with bevel-edged annular grooves 127 and 128, annular groove 127 intersecting the bore 129, and these annular grooves and O-seals 182-185 cooperate in the following manner. When the plunger 171 is in the position shown in FIG. 9, O-seals 183 and 184 are operatively engaged against the interior of opening 126 to provide a double seal of the opening with respect to the exterior of housing 120. O-seal 182 is loosely accommodated in the annular groove 127 so that the desired gas (and pressure of gas) communication is established between the interior of housing 120 surrounding capsule 40 and the pressurized chamber to which the temperature compensated pressure differential sensing device 110 is attached. In this position, the press-to-test assembly 170 merely operates as a seal and permits the temperature compensated pressure differential sensing device 110 to operate as described above in connection with the other embodiments.

When the press-to-test plunger 171 is depressed to the test position, as shown in FIG. 11, O-seal 182 is operatively engaged against the wall of opening 126 to seal off bore 125 and prevent loss of gas from the pressurized chamber. O-seal 183 is loosely accommodated in annular groove 127 and O-seal 184 is loosely accommodated in annular groove 128, so that the interior of the housing 120 is opened to the atmosphere through opening 126. In this regard the fit between the plunger 171 and the interior of opening 126 is not, in and of itself, sufficient to establish a gas-tight seal. As noted above, the temperature compensated pressure differential sensing device is normally used in connection with pressurized chambers having pressures well above atmospheric, so that opening the interior of the housing 120 to the atmosphere substantially lowers the pressure in the housing 120 whereby the capsule 40 will expand to operate switch 151, thereby providing the alarm signal if the device is in good working order.

The press-to-test assembly 170 has several advantages over prior art press-to-test devices. A very short stroke is required to move plunger 171 from the position shown in FIG. 9 to the test position shown in FIG. 10, as only sufficient movement to place O-seals 183 and 184 in the adjacent annular grooves 127 and 128 is required. It is not necessary to move O-seals 183 and 184 past bore 129 to accomplish testing. Further, the beveled edges of annular grooves 127 and 128 do not abrade or wear the O-seals, thereby prolonging their service life and making the device less prone to failure.

It should be noted that the press-to-test subassembly can be incorporated into the previously described embodiments of the invention herein, if desired. It should also be noted that the embodiment 110 achieves a substantial reduction in the number of parts over the previously described embodiments, and provides a structure wherein the device may be easily calibrated without resort to disassembly. Further, if the switch 151 should fail, a replacement housing cap and switch subassembly may be readily installed on the base 121 without disturbing the capsule 40 mounted thereto, and the repaired device can be adjusted and tested in the field for operability.

The pressure differential sensing devices disclosed above are well suited for use in monitoring the internal pressure of helicoper blades, and are also well suited for monitoring the pressurization of any other pressurized container. The devices are rugged and highly reliable.

It will be appreciated that although the pressure differential sensing devices disclosed above provide an expandable capsule for operating a push button switch, other signal devices may by operated by the capsule. Such other devices may include potentiometers, variable transformers, or other suitable devices. It should, therefore, be understood that the foregoing description is directed to a preferred embodiment of the invention and is representative only, and various departures from the preferred embodiments shown and described may be made without departing from the spirit and scope of the invention.

I claim:

1. A pressure differential sensing device for detecting loss of gas from a gas pressurized chamber, the device comprising a flexible, gas-filled, sealed capsule mounted within a space pressurized by the gas in the pressurized chamber, the capsule comprising two convoluted diaphragms joined together along their peripheral edges, whereby the gas pressure of the chamber is applied to the outside of the capsule, and means for sensing expansion of the capsule and for providing a signal in response thereto, wherein the initial internal pressurization of the capsule is chosen such that the capsule size remains substantially constant throughout a range of temperature variations causing pressure increases and decreases in both the capsule and the chamber, whereby a loss of gas from the chamber results in a decrease of the gas pressure of the chamber relative to the internal gas pressure of the capsule thereby permitting the capsule to expand, the expansion of the capsule being sensed by the sensing means, and wherein the gas pressure of the chamber is higher than the internal gas pressure of the capsule whereby the capsule is normally compressed from its free position and failure of the capsule seal permitting equalization of the internal gas pressure of the capsule with the gas pressure of the chamber allows the capsule to expand to its free position, the expansion of the capsule being sensed by the sensing means.

2. The pressure differential sensing device as defined in claim 1 wherein the capsule and the chamber contain the same gas.

3. A pressure differential sensing device as defined in claim 1 and further comprising means for adjusting the sensing means to provide a signal in response to greater or lesser expansion of the capsule, wherein a greater or lesser pressure differential may occur between the capsule and the chamber prior to the sensing device providing the signal, said adjusting means comprising a collar having the sensing means mounted thereon, said collar being threadably mounted for positively ajusting the position of sensing means relative to the capsule upon rotation of said collar.

4. A pressure differential sensing device as defined in claim 1 wherein the capsule is mounted in a sealed housing in pressure communication with the gas pressurized chamber.

5. A pressure differential sensing device as defined in claim 4 wherein the housing comprises a mounting shank for attaching the housing to the chamber, and the mounting shank has a bore formed therethrough for providing pressure communication between the interior of the housing and the gas pressurized chamber.

6. The pressure differential sensing device as defined in claim 1 wherein the sensing means comprises a mechanically actuated switch having an actuating member positioned adjacent to the capsule, and wherein expansion of the capsule operates the switch.

7. A pressure differential sensing device as defined in claim 6 and further comprising means for adjusting the position of the switch actuating member relative to the capsule to permit greater or lesser expansion of the capsule prior to operation of the switch, said adjusting means comprising a collar having the switch actuating member mounted thereon, said collar threadably received in said housing for positively adjusting the position of the switch actuating member relative to the capsule upon rotation of the collar.

8. A pressure differential sensing device comprising:

A. a base comprising a bottom plate and a mounting shank depending from said bottom plate, said mounting shank and said bottom plate having a bore formed therethrough, and said bottom plate having a cylindrical portion with threads formed thereon;

B. a cup-shaped cap having threads formed on the side walls thereof, said cup-shaped cap threadably mounted to the threaded cylindrical portion of the bottom plate of said base, and means for sealing said cup-shaped cap to said base, whereby said base and cup-shaped cap together comprise a housing defining a sealed cavity communicating with the exterior of said housing through the bore;

C. a flexible gas-filled sealed capsule mounted on one of the base or cup-shaped cap;

D. a mechanically operated switch having an actuating member, said switch mounted on the other of the base or cup-shaped cap with the actuating member oriented toward the capsule, whereby the position of the capsule relative to the actuating member of the switch is adjustable by rotating the cup-shaped cap relative to the base; and E. signal means operated by said switch, wherein the device is attached to a pressurized chamber by means of the shank and adjusted such that a signal is produced at low pressurization of the pressurized chamber and no signal is produced at normal pressurization of the pressurized chamber, whereby a loss of gas from the chamber results in a decrease of the gas pressure of the chamber relative to the internal gas pressure of the capsule thereby permitting the capsule to expand, the expansion of the capsule operating the switch and providing a signal indicating the decrease in pressure.

9. A pressure differential sensing device as defined in claim 8 wherein the capsule comprises two convoluted diaphragms joined together along their peripheral edges.

10. A pressure differential sensing device as defined in claim 8 wherein said capsule is mounted to said base, said switch includes at least one metal switch terminal, and said switch is mounted to said cup-shaped cap by a glass header mounted to close an opening defined by said cup-shaped cap, said glass header comprising a glass plate, a metal edge member hermetically sealed to the periphery of said glass plate, and a plurality of metal eyelets corresponding to the number of metal switch terminals, each metal eyelet hermetically sealed through an opening in said glass plate, wherein each of said at least one metal switch terminals is positioned through a corresponding one of said metal eyelets and soldered thereto, and said metal edge member surrounds the opening defined by said cup-shaped cap and is soldered thereto.

11. A pressure differential sensing device as defined in claim 10 wherein said switch includes three terminals and said glass header includes three eyelets positioned to receive said three switch terminals.

12. A pressure differential sensing device as defined in claim 8 wherein said base defines an opening partially therethrough, said opening including at least one annular groove, said opening intersecting the bore such that a first portion of the bore extending from the shank to the opening intersects the opening inwardly from said annular groove and a second portion of the bore extending from said opening through the bottom plate intersects the opening within said annular groove, and further comprising:

F. a plunger slidably mounted in said opening, said plunger defining first and second spaced-apart annular plunger grooves thereabout; and G. a first O-seal received in the first annular plunger groove and a second O-seal received in the second annular plunger groove, said first and second O-seals thereby slidably carried by said plunger, wherein said plunger is slidable between (1) a first position wherein said first O-seal is loosely accommodated in said annular groove of said opening thereby permitting gas communication through said bore and opening to the sealed cavity, and said second O-seal is engaged between said plunger and the base defining said opening, thereby preventing gas communication to the exterior of the housing through said opening, and (2) a second position wherein said first O-seal is engaged between said plunger and said base defining said opening between the intersection of the first portion of the bore with said opening and the intersection of the second portion of the bore with said opening, thereby blocking communication through said bore and opening to the sealed cavity, and said second O-seal is loosely accommodated in the annular groove of said opening to permit gas communication between said sealed cavity and the exterior of said base through said opening.

13. A pressure differential sensing device as defined in claim 12 wherein said plunger is spring-biased from said second position toward said first position.

14. A pressure differential sensing device as defined in claim 12 wherein said opening includes a second annular groove, said second annular groove located between the first annular groove of said opening and the exterior of the base, said plunger defines a third annular plunger groove spaced apart from the second annular plunger groove by the same distance separating the first and second annular grooves of said opening, and further comprising a third O-seal carried in said third annular plunger groove, whereby when the plunger is in its first position, the third O-seal is also engaged between the plunger and said base defining said opening to provide a double seal between the sealed cavity and the exterior of the housing, and when said plunger is in said second position, said third O-seal is loosely accommodated in said third annular groove of said opening to permit gas communication between said sealed cavity and the exterior of said housing.

15. A pressure differential sensing device comprising:

A. a mechanically operated switch including an actuating member and at least one metal switch terminal;

B. a glass header comprising a glass plate, a metal edge member hermetically sealed to the periphery thereof, and a plurality of metal eyelets corresponding to the number of switch terminals of said switch, each metal eyelet hermetically sealed to an opening in said glass plate, wherein each of said at least one metal switch terminals is positioned in a corresponding one of said eyelets and soldered thereto to mount said switch to said glass header;

C. a metal housing defining a cavity, an inlet bore to said cavity and a mounting shank at least partially defining said inlet bore for connecting said inlet bore to a pressurized chamber, said housing further defining an opening, wherein said glass header with said switch mounted thereto is secured to said housing by soldering said metal edge member to said housing about said opening with said switch actuating member disposed within said cavity, thereby sealing said cavity except for said inlet bore;

D. a flexible gas-filled sealed capsule mounted to said housing in said cavity adjacent to the switch actuating member; and E. signal means operated by said switch;

wherein the device is attached to pressurized chamber with the inlet bore in communication therewith, whereby the gas pressure of said chamber acts on the exterior of said capsule, whereby a loss of gas from the chamber results in a decrease of the gas pressure in the chamber relative to the internal gas pressure of the capsule, thereby permitting the capsule to expand, the expansion of the capsule operating the switch and providing a signal indicating the decrease in pressure.

16. A pressure differential sensing device as defined in claim 15 wherein said housing defines an opening partially therethrough, said opening including at least one annular groove, said opening intersecting the inlet bore such that a first portion of the bore extending from the shank to the opening intersects the opening inwardly from said annular groove and a second portion of the bore extending from said opening to said cavity intersects the opening within said annular groove, and further comprising:

F. a plunger slidably mounted in said opening, said plunger defining first and second spaced-apart annular plunger grooves thereabout; and G. a first O-seal received in the first annular plunger groove and a second O-seal received in the second annular plunger groove, said first and second O-seals thereby slidably carried by said plunger, wherein said plunger is slidable between (1) a first position wherein said first O-seal is loosely accommodated in said annular groove of said opening thereby permitting gas communication through said bore and opening to the sealed cavity, and said second O-seal is engaged between said plunger and the base defining said opening, thereby preventing gas communication to the exterior of the housing through said opening, and (2) a second position wherein said first O-seal is engaged between said plunger and said base defining said opening between the intersection of the first portion of the bore with said opening and the intersection of the second portion of the bore with said opening, thereby blocking communication through said bore and opening to the sealed cavity, and said second O-seal is loosely accommodated in the annular groove of said opening to permit gas communication between said sealed cavity and the exterior of said base through said opening.

17. A pressure differential sensing device comprising:

A. a base having 1. a bottom plate,
2. a cylindrical side wall upstanding therefrom, said side wall having threads formed thereon,
3. a mounting shank depending from the bottom plate, said mounting shank and bottom plate having a bore formed therethrough;

B. a flexible gas-filled sealed capsule comprising two convoluted diaphragms joined together along their peripheral edges, said capsule mounted on said bottom plate;

C. a generally cylindrical housing cap having threads formed thereon, said housing cap threadably mounted to the cylindrical side wall of said base, said side wall and said housing cap surrounding said capsule, and sealing means sealing said side wall and said housing wall, said housing cap defining an opening;

D. a glass header closing the opening defined by said cylindrical housing cap, said glass header comprising a glass plate, a metal edge member hermetically sealed to the periphery of said glass plate, and at least one metal eyelet mounted through said glass plate and hermetically sealed thereto, said glass header secured to said housing cap by soldering the metal edge member thereto about said opening, whereby said base, housing cap and glass header together define a chamber enclosing said capsule and whereby said bore provides communication into said chamber.

E. a mechanically operated switch including an actuating member and at least one metal switch terminal, said terminal extending through and soldered to said metal eyelet of said glass header to mount said switch to said glass header, said switch oriented with said actuating member disposed toward said capsule, whereby the position of said actuating member relative to said capsule is adjusted by rotating said housing cap relative to said base on the threads mounting said housing cap to said base; and F. signal means operated by said switch, wherein the device is attached to a pressurized chamber by means of the shank and adjusted such that a signal is produced at low pressurization of the pressurized chamber and no signal is produced at normal pressurization of the pressurized chamber, whereby a loss of gas from the chamber results in a decrease of the gas pressure of the chamber relative to the internal gas pressure of the capsule thereby pemitting the capsule to expand, the expansion of the capsule operating the switch and providing a signal indicating the decrease in pressure.

18. A pressure differential sensing device as defined in claim 17 wherein said base defines an opening partially therethrough, said opening including at least one annular groove, said opening intersecting the bore such that a first portion of the bore extending from the shank to the opening intersects the opening inwardly from said annular groove and a second portion of the bore extending from said opening through the bottom plate intersects the opening within said annular groove, and further comprising:

G. a plunger slidably mounted in said opening, said plunger defining first and second spaced-apart annular plunger grooves thereabout; and H. a first O-seal received in the first annular plunger groove and a second O-seal received in the second annular plunger groove, said first and second O-seals thereby slidably carried by said plunger, wherein said plunger is slidable between (1) a first position wherein said first O-seal is loosely accommodated in said annular groove of said opening thereby permitting gas communication through said bore and opening to the sealed cavity, and said second O-seal is engaged between said plunger and the base defining said opening, thereby preventing gas communication to the exterior of the housing through said opening, and (2) a second position wherein said first O-seal is engaged between said plunger and said base defining said opening between the intersection of the first portion of the bore with said opening and the intersection of the second portion of the bore with said opening, thereby blocking communication through said bore and opening to the sealed cavity, and said second O-seal is loosely accommodated in the annular groove of said opening to permit gas communication between said sealed cavity and the exterior of said base through said opening.

19. A pressure differential sensing device as defined in claim 18 wherein said plunger is spring-biased from said second position toward said first position.

20. A pressure differential sensing device as defined in claim 18 wherein said opening includes a second annular groove, said second annular groove located between the first annular groove of said opening and the exterior of the base, said plunger defines a third annular plunger groove spaced apart from the second annular plunger groove by the same distance separating the first and second annular grooves of said opening, and further comprising a third O-seal carried in said third annular plunger groove, whereby when the plunger is in its first position, the third O-seal is also engaged between the plunger and said base defining said opening to provide a double seal between the sealed cavity and the exterior of the housing, and when said plunger is in said second position, said third O-seal is loosely accommodated in said third annular groove of said opening to permit gas communication between said sealed cavity and the exterior of said housing.

21. A pressure differential sensing device as defined in claim 20 wherein the annular grooves of said opening are bevel-edged.

* * * * *